US005722310A

United States Patent [19]

Ota et al.

[11] Patent Number: 5,722,310

[45] Date of Patent: Mar. 3, 1998

[54] SINGLE HEADED PISTON TYPE VARIABLE CAPACITY REFRIGERANT COMPRESSOR PROVIDED WITH AN IMPROVED INCLINATION LIMITING MEANS FOR A SWASH PLATE ELEMENT

[75] Inventors: Masaki Ota; Masaya Nakamura; Shigeyuki Hidaka; Hisakazu Kobayashi, all of Kariya, Japan

[73] Assignee: Kabushiki Kaisha Toyoda Jidoshokki Seisakusho, Kariya, Japan

[21] Appl. No.: 729,646

[22] Filed: Oct. 21, 1996

[30] Foreign Application Priority Data

Oct. 19, 1995 [JP] Japan ..... 7-271266

[51] Int. Cl.[6] ..... F04B 1/26

[52] U.S. Cl. ..... 92/12.2; 417/222.2

[58] Field of Search ..... 417/222.2, 269; 91/499, 504, 505; 92/12.2

[56] References Cited

U.S. PATENT DOCUMENTS

| | | | |
|---|---|---|---|
| 4,729,719 | 3/1988 | Kayukawa et al. . | |
| 5,540,559 | 7/1996 | Kimura et al. | 92/12.2 |
| 5,573,379 | 11/1996 | Kimura et al. | 417/222.2 |
| 5,582,092 | 12/1996 | Nomura et al. | 417/222.2 |
| 5,644,968 | 7/1997 | Kimura et al. | 92/12.2 |

FOREIGN PATENT DOCUMENTS

| | | |
|---|---|---|
| 0219298 | 4/1987 | European Pat. Off. . |
| 4311432 | 10/1993 | Germany . |
| 4411926 | 10/1994 | Germany . |
| 63-205470 | 8/1988 | Japan . |

*Primary Examiner*—Charles G. Freeay
*Attorney, Agent, or Firm*—Burgess, Ryan & Wayne

[57] ABSTRACT

A variable capacity refrigerant compressor has a rotating drive shaft, a plurality of single headed pistons reciprocating in respective cylinder bores for sucking, compressing and discharging refrigerant gas, a rotor element mounted on the drive shaft to be rotated with the drive shaft, a swash plate element engaged with the rotor element via a hinge unit and with the pistons via shoes, the swash plate element rotating with the rotor element and reciprocating the pistons. The swash plate changes its angle of inclination to vary the discharge capacity of the compressor, and the maximum angular position of inclination of the swash plate element is limited by an inclination limiting unit formed by a first contacting area formed in the rotor element, and a second contacting area formed in the swash plate so as to come into contact with the first contact area when the swash plate element reaches the maximum angle position of inclination. The second contacting area is formed in a suction actuating region of the swash plate element which is separated from a compression and discharge actuating region of the swash plate with respect to a line of inclination of the swash plate. The hinge unit has an engaging point between the swash plate element and the rotor element which is located in the compression and discharge region of the swash plate element with respect to the line of inclination of the swash plate element.

6 Claims, 3 Drawing Sheets

SINGLE HEADED PISTON TYPE VARIABLE CAPACITY REFRIGERANT COMPRESSOR PROVIDED WITH AN IMPROVED INCLINATION LIMITING MEANS FOR A SWASH PLATE ELEMENT

BACKGROUND OF THE INVENTION

1. Field of the Invention

The present invention relates generally to a variable capacity single headed piston type refrigerant compressor having an incorporated swash plate element capable of changing an angle of inclination thereof. More particularly, the present invention relates to an improvement in an inclination limiting means for limiting a maximum angle of inclination of a swash plate element of the above defined type refrigerant compressor. It should be noted that the above-mentioned swash plate element technically includes a wobble plate type piston actuating element consisting of a combination of a rotating swash plate and a non-rotatable wobble plate connected to pistons via connecting rods, and a single rotating swash plate connected to each of pistons via a pair of shoes.

2. Description of the Related Art

Many types of refrigerant compressors are used for compressing refrigerant gas in climate control systems in automobiles and vehicles. Wobble plate type variable capacity compressors and swash plate type variable capacity compressors are typical refrigerant compressors for the climate control systems of automobiles. In wobble plate type compressors and swash plate type compressors, a swash plate element is engaged with single headed pistons via suitable rotation-to-reciprocat ion converting elements such as shoes and connecting rods with ball-and-sockets, so as to reciprocate the respective single headed pistons of the compressors in response to either a nutating motion or a rotating motion of the swash plate element. The swash plate element is usually connected to a rotor element, attached to rotatable drive shaft, via a hinge unit disposed between the rotor element and the swash plate element, so that the swash plate element is rotationally driven by the rotor element via the hinge unit. Also, the swash plate element is supported within a crank chamber to turn about a given fulcrum to thereby change its angle of inclination from a plane perpendicular to the axis of rotation of the drive shaft. Thus, when a pressure prevailing in the crank chamber is adjustably changed so as to control a pressure acting on the back of each of the single headed pistons, the respective pistons are permitted to axially reciprocate in respective cylinder bores to an extent until the controlled pressure acting on the back of the pistons balances with a pressure of the suction gas, i.e., a suction pressure acting on the front end of the respective pistons, and the angle of inclination of the swash plate element engaged with the respective pistons is adjustably changed. Namely, the stroke of the respective pistons are variably controlled. Therefore, the swash plate element can change its angle of inclination between a predetermined minimum and maximum angle positions to thereby determine the minimum capacity of the compressor on the basis of the smallest stroke of the pistons, and the maximum capacity of the compressor on the basis of the largest stroke of the pistons.

The above-mentioned predetermined minimum and maximum angle positions in inclination of the swash plate element are usually defined by an inclination limiting unit. One typical inclination limiting unit for an inclinable swash plate element is formed by providing the above-mentioned hinge unit at a connection portion of the swash plate element and the rotor element with a suitable limiting function. However, this type of known inclination limiting unit is physically weak, and is not sufficiently accurate.

Another known inclination limiting unit for an inclinable swash plate, particularly, a maximum inclination limiting unit is provided by mechanical contact between a portion of a rotor element and a portion the swash plate element capable of relatively inclining in relation to the rotor element. The maximum inclination limiting unit constituted by the mechanical contact between the rotor element and the swash plate element can be physically strong, and accurate in operation.

For example, Japanese Unexamined Patent Application publication (Kokai) No. 63-205470 (JP-A-'470) discloses a single headed piston type refrigerant compressor provided with a swash plate element having a rotating swash element and a non-rotating wobble plate operatively connected to respective pistons. In the compressor, a maximum inclination limiting unit for the swash plate element is formed by a combination of a recess formed in a lower portion of a swash-plate-support arm (i.e., a rotor element) secured to a drive shaft, and a projection provided in a body portion of the swash plate at a position permitting the projection to come into contact with the bottom face of the recess of the rotor element when the swash plate element is inclined to the maximum angle position of inclination.

Nevertheless, JP-A-'470 does not include any detailed description of the concrete construction and disposition of the recess and the projection of the maximum inclination limiting unit for the swash plate element. However, from the illustration of FIG. 1 of JP-A-'470, it is evident that the contacting area of the projection of the swash plate element and the bottom face of the recess of the rotor element extends in an extended region surrounding the drive shaft. When the compressor of JP-A-'470 operates by the rotation of the drive shaft, the swash plate element is subjected to a thrust load exerted by the respective pistons compressing the refrigerant gas in the cylinder bores, via a wobble plate mounted on the swash plate. The thrust load is not a constant load and varies, and the position at which the swash plate element receives the varying thrust load gradually moves on the swash plate in response to the rotation thereof. However, the center of the varying thrust load is always located at a predetermined point of the hinge unit between the rotor element and the swash plate element, i.e., a contacting point of a pin member of the hinge unit projecting from the swash plate and an elongated hole of the hinge unit bored in the rotor element. The center of the varying thrust load is shifted from a diametrical line passing through top and bottom dead centers of the swash plate where the swash plate is in registration with the piston reaching the end of the compressing stroke thereof and with the piston reaching the end of the suction stroke thereof. The above-mentioned diametrical line can be considered as a line of inclination of the swash plate element, and the above-mentioned shifting of the center of the varying thrust load generates a momentary force or torque which forces the swash plate element to turn about the line of inclination thereof. Moreover, the momentary force increases proportionally with an increase in the capacity of the compressor. Therefore, when the swash plate element is moved to the maximum angle position of inclination, the compressor operates with the maximum capacity, and the momentary force turning the swash plate element about the line of inclination of the swash plate element becomes the maximum.

Nevertheless, as stated above, when the swash plate is rotated together with the drive shaft at a given inclination-angle-position thereof, a change in the position of action of the thrust load on the swash plate element occurs a plurality of times, corresponding to the number of the cylinder bores of the compressor, during one complete rotation of the swash plate. More specifically, at every one of the plurality of times the position of action of the thrust load gradually moves in a region extending over both sides with respect to the pivotally engaging point of the swash plate element and the rotor element which forms a hinge unit between the swash plate and rotor elements. The hinge unit is usually arranged at a position circumferentially shifted from the top dead center of the swash plate element toward a region of the swash plate element acting as a compressing-discharging operation region of the swash plate element. Therefore, when the position of action of the thrust load moves to pass through the hinge unit, the momentary force or torque acting on the swash plate element with respect to the pivotally engaging point delicately changes its direction of action. Accordingly, when the contacting area of the maximum inclination limiting unit of the swash plate element is formed in two regions of the swash plate, i.e., regions acting as the compressing-discharging operation region, and acting as the sucking operation region with respect to the line of inclination of the swash plate, the contacting area formed in the sucking operation region of the swash plate element moves into and away from contact with the contacting area of the rotor element due to the change in the acting direction of the momentary force or torque. The contacting area formed in the compressing-discharging operation region of the swash plate element is maintained in constant contact with the contacting area of the rotor element. Accordingly, the swash plate vibrates to generate noise.

SUMMARY OF THE INVENTION

Therefore, an object of the present invention is to provide a variable capacity refrigerant compressor having a swash plate element for reciprocating single headed pistons within cylinder bores and including a maximum inclination limiting unit for the swash plate element which is improved so as to stably maintain the maximum inclination position of the swash plate element while reducing vibratory movement of the swash plate element and noise of the compressor.

In order to achieve the above object, there is provided a variable capacity refrigerant compressor including an axially extending cylinder block having a plurality of axial cylinder bores formed therein and forming a part of an outer framework of the compressor, a plurality of pistons slidably fitted in the cylinder bores to compress a refrigerant gas, a front housing secured to an axially front end of the cylinder block and defining therein a crank chamber, a drive shaft rotatably supported and housed by the cylinder block and the front housing and rotating about an axis of rotation thereof upon being driven, a rear housing secured to a rear end of the cylinder block and defining therein a suction chamber and a discharge chamber, a rotor element mounted on the drive shaft to be rotated together therewith, a swash plate element connected, via a hinge unit, to the rotor element so as to be synchronously rotated with the rotor element, and operatively engaged with the plurality of pistons to actuate sucking, compressing and discharging operations of the pistons, the swash plate element having a suction actuating region and a compression and discharge actuating region separated by a predetermined line which corresponds to a line of inclination of the swash plate changing an angle of inclination thereof with respect to a plane perpendicular to the axis of rotation of the drive shaft in response to a difference in pressures prevailing in the crank chamber and the suction chamber, and an inclination limiting unit arranged between the rotor element and the swash plate element to limit the inclination of the swash plate element to a predetermined maximum angular position, wherein the hinge unit includes a pivotally engaging point between the rotor and swash plate elements to permit the rotor and swash plate elements to synchronously rotate and also permit the swash plate element to change its angle of inclination, the pivotally engaging point of the hinge unit being positioned to be displaced from the top dead center of the swash plate element toward the compression and discharge actuating region around the axis of rotation of the drive shaft, and wherein the inclination limiting unit comprises a first contacting area formed in the rotor element and a second contacting area formed in the swash plate element, said first and second contacting areas coming into contact with one another when the inclination of the swash plate element reaches the maximum angular position, the second contacting area of the swash plate element being disposed in the suction actuating region of the swash plate with respect to the line of inclination of the swash plate.

The predetermined line of the swash plate element corresponding to the line of inclination thereof is a line passing the top dead center of the swash plate element at which the swash plate element is operatively engaged with one of the pistons which is moved to its top dead center, and the bottom dead centers of the swash plate element which the swash plate element is operatively engaged with one of the pistons which is moved to its bottom dead center.

Preferably, the swash plate element comprises a single piece of a disk-like member having a substantially central bore formed therein for permitting the drive shaft to axially extend therethrough, the central bore of the swash plate element being formed to have a support portion at which the swash plate element is locally and pivotally supported by a portion of the drive shaft so as to be able to change the angle of inclination thereof, and the portion of the drive shaft being located on the side opposite to the hinge unit with respect to the axis of rotation of the drive shaft.

Further, the second contacting area formed in the suction actuating region of the swash plate element is located in one of four quadrants of the swash plate element which are defined by the predetermined line and a line vertically crossing the predetermined line, and the quadrant in which the second contacting area is located includes the bottom dead center of the swash plate element.

The second contacting area of the swash plate element is an end surface of a projection formed in a portion of the swash plate element facing the rotor element.

In accordance with the construction of the inclination limiting unit incorporated in a variable capacity refrigerant compressor according to the present invention the swash plate element can be stably held at the maximum angle of inclination even when the line of action of the thrust load acting on the swash plate element due to compression of the refrigerant gas varies. This is because when the swash plate element is moved to the position of the maximum angle of inclination, the swash plate element is in stable contact with the rotor element by the contacting of the first contact area of the rotor element with the second contacting area of the swash plate element formed in the suction actuating region thereof which is not directly subjected to the thrust load. Namely, the swash plate element cannot be subjected to a vibration generating momentary force or torque which is experienced by the swash plate element of the aforementioned compressor of JP-A-'470.

When the swash plate element is provided with a substantially central bore through which the drive shaft axially extends so as to directly support the drive shaft, although the swash plate element cannot receive sufficient physical support from the drive shaft to resist the momentary force or torque acting on the swash plate element due to such a reason that a contacting portion between the swash plate element and the drive shaft is very small, the inclination limiting unit according to the present invention can be very effective for stably supporting the swash plate when the swash plate element is moved to the maximum angle position of inclination thereof.

Further, when the second contacting area of the swash plate element is formed by the end surface of the projection formed in a portion of the swash plate element, since the projection per se can be a portion of the swash plate which is provided for obtaining a dynamic balance of the swash plate element during the rotation thereof, the second contacting area can be simultaneously produced with the balancing purpose projection. Thus, the second contacting area can be easily produced at a low manufacturing cost.

BRIEF DESCRIPTION OF THE DRAWINGS

The above and other objects, features, and advantages of the present invention will be made more apparent from the ensuing description of a preferred embodiment thereof with reference to the accompanying drawings wherein.

DESCRIPTION OF THE PREFERRED EMBODIMENT

Figure 1:
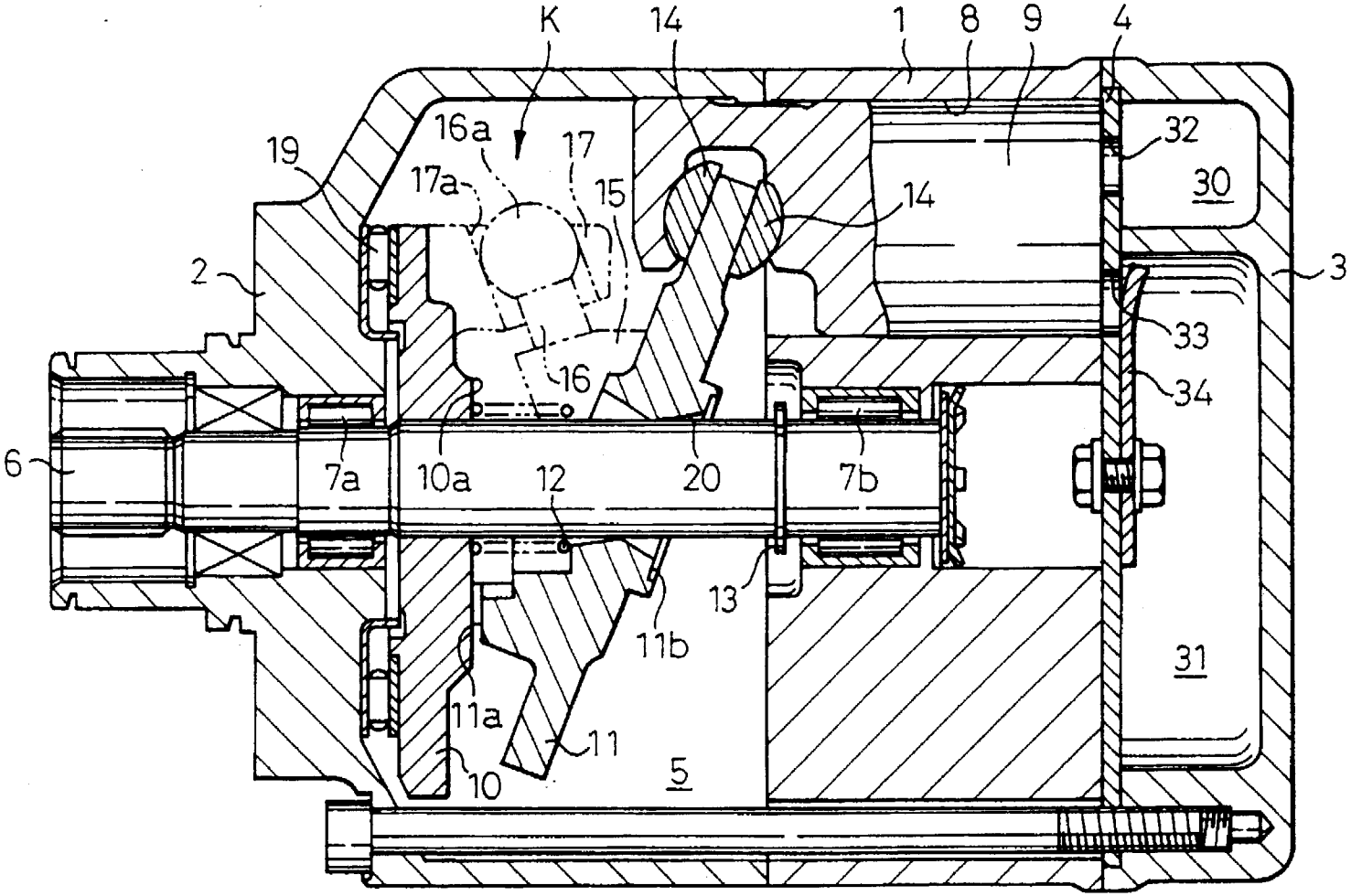
FIG. 1 is a longitudinal cross-sectional view of a variable capacity refrigerant compressor having single headed pistons reciprocatingly driven by a swash plate element, according to a preferred embodiment of the present invention.

Referring to FIG. 1, the variable capacity refrigerant compressor has a cylinder block 1 having axially opposite ends, i.e., a front end and a rear end. The front end of the cylinder block 1 is closed by a bell-shaped front housing 2 hermetically secured to the cylinder block 1, and the rear end of the cylinder block 1 is closed by a rear housing 3 also hermetically secured to the cylinder block 1 via a valve plate 4. The cylinder block 1 and the front housing 2 define an interior crank chamber 5 located in front of the front end of the cylinder block 1. The crank chamber 5 is formed so as to permit a drive shaft 6 to axially extend therethrough. The drive shaft 6 is rotatably supported by the front housing 2 and the cylinder block 1 via a front bearing 7*a* and a rear bearing 7*b* which are anti-friction radial type bearings. A frontmost end of the drive shaft 6 extends toward a front opening of the front housing 2 so as to receive an external drive force from a non-illustrated drive source such as an automobile engine. When driven, the drive shaft 6 rotates about a central axis of rotation thereof to thereby operate the compressor as described later.

The cylinder block 1 is provided with a plurality of cylinder bores 8 extending axially from the front end to the rear end. The cylinder bores 8 are arranged around the axis of rotation of the drive shaft 6 so as to be parallel with one another. The respective cylinder bores 8 receive therein pistons 9, i.e., single headed pistons, in such a manner that the respective pistons 9 are slidable within the respective cylinder bores 8.

The drive shaft 6 has a rotor element 10 fixedly mounted thereon at a position adjacent to an inner end wall of the front housing 2 via a thrust bearing 19. Thus, the rotor element 10 is rotated together with the drive shaft 6 within the crank chamber 5.

A swash plate element 11 is mounted on the drive shaft 6 at a position spaced rearwardly from the motor element 10 and at a substantially central position within the crank chamber 5. The swash plate element 11 is provided with a substantially central bore 20 through which the drive shaft 6 axially extends.

Figure 2:
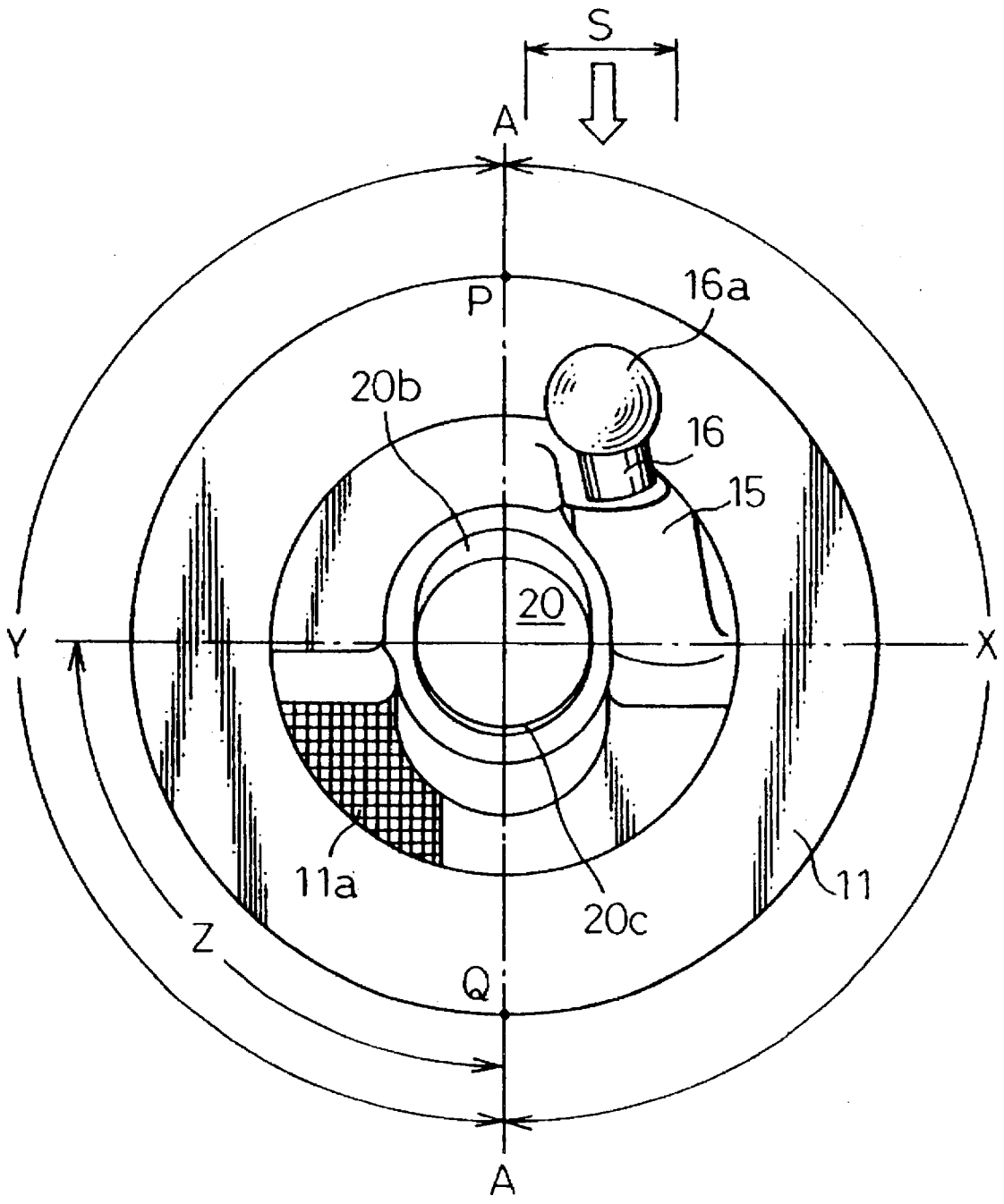
FIG. 2 is a front view, of a swash plate element incorporated in the compressor of FIG. 1, illustrating a position of a part of a hinge unit provided from the swash plate element, and a contacting area of an inclination limiting means formed in the swash plate element.
Figure 3:
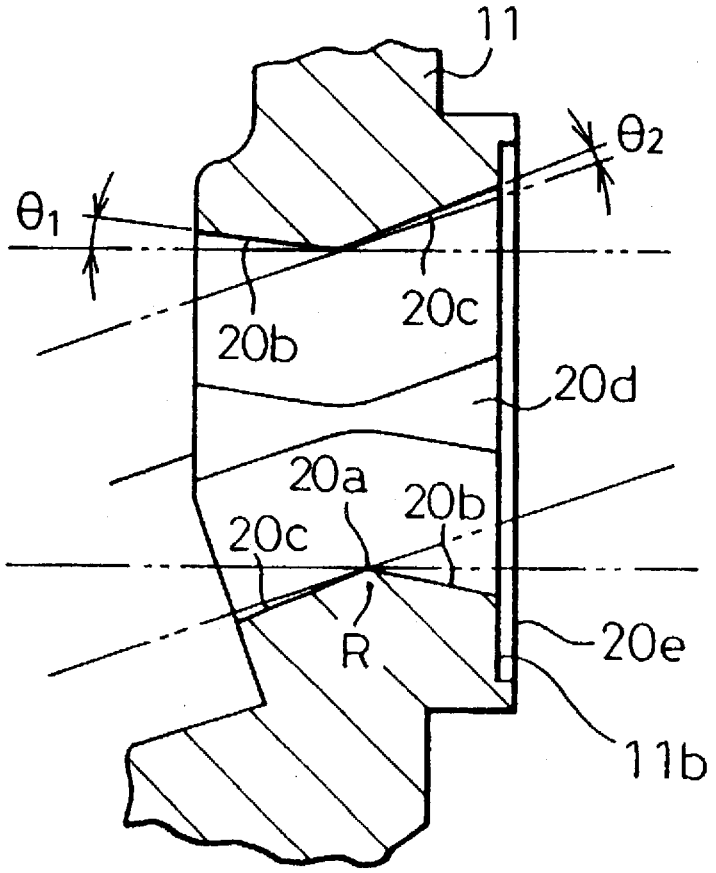
FIG. 3 is a cross-sectional view of a central portion of the same swash plate element as that of FIG. 2, illustrating a substantially central bore formed in the central portion.

The central bore 20 of the swash plate 11 has an axially non-linear cylindrical shape but is formed in a bore consisting of a combination of two different bores 20*b* and 20*c* which are slanted from an axis perpendicular to an end face 20*e* of the swash plate element 11 as shown in detail in FIG. 3. The two slanted bores 20*b* and 20*c* are formed so as to cross at a substantially middle position of the bore 20 of the swash plate element 11, and to permit the swash plate 11 to turn about an axis "R" shown in FIG. 3 to thereby change its angle of inclination from its minimum angle position of inclination to its maximum angle position of inclination. At this stage it should be understood on the basis of the illustrations of FIGS. 2 and 3 that the axis "R" is arranged inside the swash plate element per se and at a position on the side opposite to a later-described hinge unit "K" (FIG. 2) with respect to the axis of rotation of the drive shaft 6. The two slanted bores 20*b* and 20*c* provide a support portion 20*a* rounded about the above-mentioned axis "R" and extending arcuately about an axis coinciding with the axis of rotation of the drive shaft 6. The swash plate element 11 is supported on the drive shaft 6 via the support portion 20*a* and is prevented by the support portion 20*a* from radially moving in a plane extending vertically to the axis of rotation of the drive shaft 6 and containing therein a line A—A of inclination of the swash by which the swash plate element 11 is inclinably supported on the drive shaft 6.

As best shown in FIG. 3, the bore 20*b* of the swash plate element 11 is formed so as to provide a small angular space $\theta_1$ (10 through 15 degrees) between the outer circumference of the drive shaft 6 and the swash plate element 11 when the latter element 11 is moved to the minimum angle position of inclination. On the other hand, the bore 20*c* of the swash plate element 11 is formed so as to provide a different small angular space $\theta_2$ (1 through 2 degrees) between the outer circumference of the drive shaft 6 and the swash plate element 11 when the latter element 11 is moved to the maximum angle position of inclination.

In FIG. 3, reference numeral 20*d* indicates flat inner face portions formed in the side of the central bore 20 of the swash plate element 11. The flat face portions 20*d* are formed during the formation of the above-mentioned slanted bores 20*b* and 20*c*.

Referring again to FIG. 1, a coil spring 12 is arranged between the rotor element 10 and the swash plate element 11 for constantly rearwardly urging the swash plate element 11. The swash plate element 11 is provided with outer annular faces which are engaged with respective pistons 9 via shoes 14, 14 having a half-spherical engaging faces fitted in spherical recesses formed in respective pistons 9, as typically shown with one of the pistons in FIG. 1. Thus, when the swash plate element 11 is rotated together with the drive shaft 6, the pistons 9 are reciprocated in the respective cylinder bores 8. Namely, the engagement of the annular portion of the swash plate element 11, and the shoes 14, 14 constitute a rotation-to-reciprocation converting mechanism.

The swash plate element 11 is provided with a bracket 15 shown by a chain line in FIG. 1, which is formed in a portion thereof on the front side. The bracket 15 in the shape of a projection is provided for forming a part of the hinge unit "K" between the swash plate element 11 and the rotor element 10. The bracket 15 is provided with an end portion to which an end of a guide pin 16 is secured. The guide pin 16 projects toward the rotor element 10, and has an outer end in which a spherical portion 16*a* is formed. The spherical portion 16*a* is received in an hole 17*a* of a support arm 17 formed in a portion of the rotor element 10 on the rear side thereof. As shown by a chain line in FIG. 1, the support arm 17 projects toward the guide pin 16 of the swash plate element 11, and forms a part cooperating with the bracket 15 and the guide pin 16 in order to constitute the hinge unit "K". Since the hinge unit "K" is actually arranged at a circumferentially different position with respect to the piston 9 shown by a solid line in FIG. 1, it is shown by the chain line in FIG. 1. The guide hole 17*a* of the support arm 17 is arranged to be parallel with a plane extending so as to contain therein the line A—A of inclination of the swash plate element 11 and the axis of rotation of the drive shaft 6. The guide hole 17*a* is bored so as to radially extend toward and to be slanted rearwardly when it approaches toward the axis of rotation of the drive shaft 6. The guide hole 17*a* of the support arm 17 receiving therein the spherical portion 16*a* of the hinge unit "K" has a center line thereof which is provided so that when the swash plate element 11 changes its angle of inclination under the restrained guide of the hinge unit "K", the position of the top dead center of the respective pistons 9 operatively engaged with the swash plate element 11 is substantially unchanged.

The rear housing 3 is provided therein with a suction chamber 30 for receiving refrigerant gas to be compressed and a discharge chamber 31 for the compressed refrigerant gas. The suction and discharge chambers are hermetically separated from one another. The valve plate 4 is provided with suction ports 32 formed therein for providing fluid communication between compression chambers formed in the respective cylinder bores 8 between the valve plate 4 and the pistons 9, and the suction chamber 30. The valve plate 4 is also provided with discharge ports 33 formed therein for providing fluid communication between the compression chambers in the respective cylinder bores 8 and the discharge chamber 31.

The suction ports 32 of the valve plate 4 are covered by conventional suction valves e.g., suction reed valves which open and close in response to the reciprocation of the pistons 9, and the discharge ports 33 of the valve plate 4 are covered by conventional discharge valves, e.g., discharge reed valves arranged between the valve plate 4 and the valve retainer 34 in response to the reciprocation of the pistons 9. The rear housing 3 receives therein a control valve (not shown) for controlling a pressure prevailing in the crank chamber 5. A typical control valve is disclosed in U.S. Pat. No. 4,729,719 to Kayukawa et al., and assigned to the same assignee as the present application.

The swash plate element 11 is provided with a counter bore 11*b* formed at the rearmost end of the central bore 20. The counter bore 11*b* is provided to come into contact with a stop ring 13 secured to a rear portion of the drive shaft 6 when the swash plate 11 is moved to the position of the minimum angle of inclination. Namely, the counter bore 11*b* of the swash plate element 11 and the stop ring 12 constitute a minimum inclination limiting unit. On the other hand, the position of the maximum angle of inclination of the swash plate element 11 is limited by contacting areas formed in the rotor element 10 and the swash plate element 11. Namely, the limiting unit for limiting the position of the maximum angle of inclination of the swash plate element 11 is constituted by contacting areas of the rotor element 10 and the swash plate element 11 which are improved according to the present invention, and is described hereinbelow with reference to FIG. 2.

Referring to FIG. 2, the bracket 15 and the guide pin 16 of the hinge unit "K" provided on the front side of the swash plate element 11 are arranged at a position displaced from the position of the top dead center "P" of the swash plate element 11 toward a region of the swash plate which belongs to a rotatingly leading side of the swash plate element 11, i.e., toward a region "X" with respect to the line A—A of inclination of the swash plate element 11. The region "X" functions to actuate compressing and discharging operation of the respective single headed pistons 9 during the rotation of the swash plate element 11. Thus, the region "X" of the swash plate element 11 can be defined as the compression-discharge actuating region of the swash plate element 11. Then, the remaining region "Y" of the swash plate element 11 functions to actuate a sucking operation of the respective single headed pistons 9. Thus, the region "Y" of the swash plate element 11 can be defined as the suction actuating region of the swash plate element 11.

In the swash plate element 11 of the present invention, a contacting area 11*a* of the swash plate element 11 which comes in contact with the rotor element in order to limit the position of the maximum angle of inclination of the swash plate element 11 is arranged in a portion of the suction actuating region "Y" of the swash plate element 11. More particularly, the contacting area 11*a* of the swash plate element 11 which comes in contact with a rear contacting area 10*a* of the rotor element 10 is selectively formed in a quadrant "Z" of the suction actuating region "Y" which is one of the four quadrants defined by the line A—A of inclination of the swash plate and another line perpendicular to the line A—A. It should be noted that the quadrant "Z" of the swash plate element 11 contains therein the bottom dead center "Q" of the swash plate element 11. The contacting area 11*a* of the swash plate element 11 is formed as a flat end surface of a projection formed in the above-mentioned quadrant "Z", and has a fan-like shape as best shown in FIG. 2.

When the variable capacity refrigerant compressor having the above-mentioned internal construction is operated by the rotation of the drive shaft 6, the swash plate 11 connected to the rotor element 10 via the hinge unit "K" is rotated together with the drive shaft 6. Therefore, the single headed pistons 9 are reciprocated in the respective cylinder bores 8 via the shoes 14, 14. Thus, the refrigerant gas is sucked from the suction chamber 30 into compression chambers of the respective cylinder bores 8 via the suction ports 32. The sucked refrigerant gas is compressed within the compression chambers of the respective cylinder bores 8, and is discharged from the respective cylinder bores 8 into the discharge chamber 31. The capacity of the compressed refrigerant gas discharged into the discharge chamber 31 is controlled by the control valve which controls the pressure level within the crank chambers.

When the pressure prevailing in the crank chamber 5 in FIG. 1 is increased by the operation of the control valve, the pressure acting on the back of the respective pistons 9 increases. Thus, the stroke of the respective pistons 9 is reduced to reduce an angle of inclination of the swash plate element 11. Namely, in the hinge unit "K", the spherical portion 16*a* of the guide pin 16 is rotationally slid down in the guide hole 17*a* of the support arm 17 toward the axis of the drive shaft 6. Accordingly, the swash plate element 11 is turned about the pivotal axis "R" at the support portion 20*a* in the central bore 20 thereof, and is moved rearwardly by the spring force of the coil spring 12 along the outer circumference of the drive shaft 6. Namely, the support portion 20*a* of the swash plate element 11 is linearly slid on the drive shaft 6. Therefore, the angle of inclination of the swash plate element 11 is reduced and, accordingly, the capacity of the compressed refrigerant gas discharged from the compression chambers of the respective cylinder bores 8 is reduced. The position of the minimum angle of inclination of the swash plate element 11 is limited when the counter bore 11*b* of the swash plate element 11 comes into contact with the stop ring 13 fixed to the rear portion of the drive shaft 6.

On the other hand, when the compressor operates at a small capacity condition, and when the pressure level in the crank chamber 5 is reduced by the pressure adjusting operation of the control valve, the pressure acting on the back of the respective pistons 9 is decreased to cause an increase in the angle of inclination of the swash plate element 11. Thus, the spherical portion 16*a* of the guide pin 16 of the hinge unit "K" is rotatingly moved up in the guide hole 17 of the support arm 17 of the hinge unit "K". Therefore, the swash plate element 11 is moved forwardly against the spring force of the coil spring 12 while maintaining slide contact of the round support portion 20*a* of the swash plate element 11 with the outer circumference of the drive shaft 6. Thus, the angle of inclination of the swash plate element 11 is increased to increase the stroke of the respective pistons 9. Accordingly, the capacity of the compressor is increased. The position of the maximum angle of inclination is limited by the inclination limiting means, i.e., by the contacting of the contacting area 11*a* (the second contacting area) of the swash plate element 11 with the rear contacting area 10*a* (the first contacting area) of the rotor element 10.

At this stage, the first contacting area 10*a* of the rotor element 10 is contacted by the second contacting area 11*a* of the swash plate element 11 which is arranged in the aforedescribed suction actuating region "Y", and more particularly, in the quadrant "Z" of the swash plate element 11 containing therein the bottom dead center "Q" of the swash plate element 11. Further, the contacting area 11*a* of the swash plate element 11 is formed as an end face of the projection of the swash plate element 11.

Therefore, when the thrust load caused by the compression of the refrigerant gas and acting on the outer annular portion of the swash plate element 11 via the respective pistons 9 dynamically changes its position of action in a region designated by "S" in FIG. 2 containing a point of engagement of the swash plate element 11 and the rotor element 10, since contact of the swash plate element 11 with the rotor element 10 does not occur in the compression and discharge actuating region "X" of the swash plate element 11, the momentary force resulting from the varying thrust load and acting on the compression and discharge region "X" of the swash plate element 11 does cause the swash plate element 11 to directly collide against a portion of the rotor element 10. More specifically, since the swash plate element 11 is in contact with the rotor element 10 by only the contacting area 11*a* formed in the suction actuating region "Y" thereof, a change in the direction of the momentary force does not provide the rotor and swash plate elements 10 and 11 with any adverse effect causing a vibratory motion of the swash plate element 11. Therefore, the swash plate element 11 can be stably held at the position of the maximum angle of inclination by the operation of inclination limiting means.

It should be understood that the above-mentioned region "S" of FIG. 2 circumferentially extends over a region containing therein a point of engagement of the swash plate element 11 with the rotor element 10, i.e., an engaging point of the spherical portion 16*a* of the guide pin 16 with the guide hole 17*a* of the support arm 17 of the hinge unit "K".

Further, in the case where the compressor has the swash plate element 11 which is directly fitted on the drive shaft 6 via the central bore 20, the engaging portion between the swash plate element 11 and the drive shaft 6 is very small. Thus, the drive shaft 6 cannot provide the swash plate element 11 with a sufficient physical support for stably holding the swash plate element 11 at a controlled angularly inclined position thereof under a varying momentary force acting on the swash plate element due to the compression of the refrigerant gas. Therefore, the existence of the inclination limiting means of the present invention for limiting the position of the maximum angle of inclination of the swash plate element 11 is very effective for stably holding the controlled position of the swash plate element 11.

Further, since the contacting area 11*a* of the swash plate 11 is formed in the end of the projection which is indispensably provided for dynamically balancing the swash plate element 11 during the rotation thereof, the formation of the contacting area 11*a* can be achieved by the production of the projection per se. Thus, the contacting area 11*a* can be easily produced at a low manufacturing cost.

In the described and illustrated embodiment of the present invention, only the contacting area 11*a* of the swash plate element 11 is formed in an end face of a projection of the swash plate element 11. However, the contacting area 10*a* of the rotor element 10 can be equally an end face of a projection formed in a part of the rotor element 10.

From the foregoing description of the embodiment of the present invention, it will be understood that according to the present invention, an improved inclination limiting unit for a swash plate of a variable capacity refrigerant compressor can be provided for stably maintaining the maximum angle position of inclination of the swash plate without generating noise.

It should be noted that many changes and variations will occur to persons skilled in the art without departing from the scope and spirit of the present invention claimed in the accompanying claims.

What we claim is:

1. A variable capacity refrigerant compressor comprising:

an axially extending cylinder block having a plurality of axial cylinder bores formed therein and forming a part of an outer framework of the compressor;

a plurality of pistons slidably fitted in the cylinder bores to compress a refrigerant gas;

a front housing secured to an axially front end of said cylinder block and defining therein a crank chamber; a drive shaft rotatably supported and housed by said cylinder block and said front housing and rotating about an axis of rotation thereof upon being driven;

a rear housing secured to a rear end of said cylinder block and defining therein a suction chamber for a refrigerant gas to be compressed and a discharge chamber for the compressed refrigerant gas;

a rotor element mounted on said drive shaft to be rotated together therewith;

a swash plate element connected, via a hinge unit, to said rotor element so as to be synchronously rotated with said rotor element, and operatively engaged with said plurality of pistons to actuate sucking, compressing and discharging operations of said pistons, said swash plate having a suction actuating region and a compression and discharge actuating region separated by a predetermined line which corresponds to a line of inclination of said swash plate changing an angle of inclination thereof with respect to a plane perpendicular to the axis of rotation of said drive shaft in response to a difference in pressures prevailing in said crank chamber and said suction chamber; and, an inclination limiting means arranged between said rotor element and said swash plate to limit the inclination of said swash plate to a predetermined maximum angular position;

wherein said hinge unit includes a pivotally engaging point between said rotor and swash elements to permit said rotor and swash plate elements to synchronously rotate and also permit said swash plate element to change an angle of inclination thereof, said pivotally engaging point of said hinge unit being positioned to be displaced from the top dead center of said swash plate toward said compression and discharge actuating region around said axis of rotation of said drive shaft, and wherein said inclination limiting means comprises a first contacting area formed in said rotor element and a second contacting area formed in said swash plate element, said first and second contacting areas coming into contact with one another when the inclination of said swash plate element reaches said maximum angular position, said second contacting area of said swash plate element being disposed in said suction actuating region of said swash plate element with respect to said line of inclination of said swash plate element.

2. A variable capacity refrigerant compressor according to claim 1, wherein said predetermined line of said swash plate corresponding to said line of inclination thereof is a line passing the top dead center of said swash plate element at which said swash plate element is operatively engaged with one of said pistons which is moved to its top dead center, and the bottom dead center of said swash plate element at which said swash plate element is operatively engaged with one of said pistons which is moved to its bottom dead center.

3. A variable capacity refrigerant compressor according to claim 1, wherein said pistons are single headed pistons having one end compressing the refrigerant gas, and the other end engaged with said swash plate element via rotation-to-reciprocation converting means.

4. A variable capacity refrigerant compressor according to claim 1, wherein said swash plate element comprises a single piece of a disk-like member having a substantially central bore formed therein for permitting said drive shaft to axially extend therethrough, said central bore of said swash plate being formed to have a support portion at which said swash plate element is locally and pivotally supported by a portion of said drive shaft so as to be able to change the angle of inclination thereof, and said portion of said drive shaft being located on a side opposite to said hinge unit with respect to the axis of rotation of said drive shaft.

5. A variable capacity refrigerant compressor according to claim 1, wherein said second contacting area formed in said suction actuating region of said swash plate element is located in one of four quadrants of said swash plate element which are defined by said predetermined line and a line vertically crossing said predetermined line, and the quadrant in which the second contacting area is located includes the bottom dead center of said swash plate element.

6. A variable capacity refrigerant compressor according to claim 1, wherein said second contacting area of said swash plate element is an end surface of a projection formed in a portion of said swash plate element facing said rotor element.

* * * * *